US005570484A

United States Patent [19]

Ogle

[11] Patent Number: 5,570,484

[45] Date of Patent: Nov. 5, 1996

[54] MATTRESS AND MATTRESS CORE HAVING DUAL RECTANGULAR INNER BORDER RODS

[75] Inventor: Steven E. Ogle, Carthage, Mo.

[73] Assignee: L&P Property Management Company, Chicago, Ill.

[21] Appl. No.: 276,000

[22] Filed: Jul. 15, 1994

[51] Int. Cl.[6] ..... A47C 27/04

[52] U.S. Cl. ..... 5/717; 5/727; 5/716

[58] Field of Search ..... 5/260, 464, 448, 5/475

[56] References Cited

U.S. PATENT DOCUMENTS

| | | | |
|---|---|---|---|
| 67,822 | 8/1867 | Vere . | |
| 986,723 | 3/1911 | King . | |
| 1,804,821 | 5/1931 | Stackhouse | 5/475 |
| 1,931,094 | 10/1933 | Suekoff . | |
| 2,120,093 | 6/1938 | Foster . | |
| 2,131,071 | 9/1938 | Raduns . | |
| 2,184,517 | 12/1939 | Duvall et al. | 5/475 |
| 2,291,390 | 7/1942 | Krakauer . | |
| 2,383,157 | 8/1945 | Pink . | |
| 2,724,842 | 11/1955 | Rogovy . | |
| 3,242,505 | 3/1966 | Tyhanic . | |
| 3,517,398 | 6/1970 | Patton . | |
| 3,689,946 | 9/1972 | Ambrose | 5/475 |
| 3,840,915 | 10/1974 | Simon . | |
| 4,101,992 | 7/1978 | Levin et al. . | |
| 4,122,566 | 10/1978 | Yates . | |
| 4,180,877 | 1/1980 | Higgins . | |
| 4,348,014 | 9/1982 | Litkewycz . | |
| 4,369,534 | 1/1983 | Wright . | |
| 5,027,459 | 7/1991 | Perry, Jr. et al. | 5/475 |
| 5,325,553 | 7/1994 | Ripley et al. . | |

*Primary Examiner*—Michael J. Milano
*Attorney, Agent, or Firm*—Wood, Herron & Evans, P.L.L.

[57] ABSTRACT

This invention is directed to an improved mattress and mattress core which provide increased firmness along the edges and transverse center section. The mattress includes a mattress core, padding over at least one side of the core, and an upholstered covering encasing the mattress core and padding. The improved mattress core has a rectangular coil spring assembly and a pair of rectangular outer border rods surrounding the assembly in the top and bottom planes of the mattress core. The improved core also includes means for increasing the firmness of the edges and the transverse center portion of the mattress, including a pair of rectangular inner border rods spaced inwardly from an outer border rod in at least one of the top and bottom planes of the rectangular coil spring assembly. A preferred embodiment has one pair of inner border rods in the top plane and a second pair in the bottom plane substantially underlying the first pair.

16 Claims, 2 Drawing Sheets

MATTRESS AND MATTRESS CORE HAVING DUAL RECTANGULAR INNER BORDER RODS

FIELD OF THE INVENTION

This invention relates to mattresses and mattress cores and, more particularly, to mattresses and mattress cores having increased firmness in particular regions of the core.

BACKGROUND OF THE INVENTION

Several patents teach the use of additional structures to stiffen particular regions of a mattress or mattress core. However, none of these patents offers the features or advantages of the present invention. For example, Higgins U.S. Pat. No. 4,180,877 teaches a mattress having increased firmness in a preselected area on both top and bottom surfaces of the mattress through use of a welded wire grid structure attached to the top and bottom surfaces of the mattress core. The wire grid provides increased firmness over the middle third of the mattress, or alternatively, over the entire mattress surface, but does not offer selective stiffening of other mattress regions.

U.S. Pat. No. 4,122,566 to Yates discloses a spring foundation unit having one or more pairs of inner border members on the top and bottom surfaces of the unit. Each inner border member has side elements extending parallel to opposed sides or ends of the spring foundation unit, and a cross-connecting element interconnecting one end of each of the inner border member side elements to form essentially U-shaped members. Each side element has a free end which is attached to a side or an end of the spring foundation unit. Although the inner border members increase firmness along portions of the mattress sides and midsection, the Yates invention does not enhance firmness along the edges of the mattress, where significant weight may be applied when a person sits on the bed.

Rogovy U.S. Pat. No. 2,724,842 teaches a mattress with independently adjustable spring means on opposite sides of the longitudinal center line of the mattress so that the hardness of the mattress halves may be independently adjusted. The spring means is supported by conventional coil springs and is provided with a crank or other means for adjusting hardness of the spring means. This stiffening device offers increased mattress firmness over a person's whole body, but does not allow for more selective stiffening of particular mattress regions.

U.S. Pat. No. 2,383,157 to Pink teaches an inner closed frame mounted on the flat surface area of the spring system. The frame is located on the surface area so that the springs located within the frame occupy the area upon which a person's greatest weight rests in the normal use of the mattress. A frame is provided on both the top and bottom surfaces of the spring system. In a bed designed for two people, two frames are used side-by-side on each mattress surface. In general, each frame provides a stiffened rectangular ring around each person's torso on the mattress. However, there is no additional support within the interior of each closed frame which is where the greatest weight will rest when a person is lying down on the mattress.

Finally, in U.S. Pat. No. 2,131,071 to Raduns, a mattress is disclosed in which the upper surface is provided with two resiliently suspended and supported platforms situated side-by-side and running lengthwise along the mattress. These platforms consist of either diagonally or laterally and longitudinally arranged strips, wires or springs which are suspended from the periphery of the bed. These platforms increase mattress firmness over the entire body region of a two person mattress, however, the '071 patent does not teach highly selective regions of increased firmness.

Therefore, it is desirable to have a mattress with enhanced firmness in the region where a person typically sits on the mattress with his or her feet on the floor, as well as a simultaneous region of enhanced firmness across the midsection of the mattress where much of a person's weight is supported.

SUMMARY OF THE INVENTION

This invention is directed to an improved mattress and mattress core for use in a mattress. The mattress includes a mattress core, padding over at least one side of the core, and an upholstered covering encasing the mattress core and padding. The improved mattress core has a rectangular coil spring assembly including a plurality of coil springs arranged in a matrix configuration having a plurality of transverse coil spring rows and a plurality of longitudinal coil spring columns. The coil spring assembly further includes a pair of rectangular outer border rods surrounding the coil springs in the top and bottom planes of the mattress core. The outer border rods are secured to at least some of the end most coils in the transverse coil spring rows and longitudinal coil spring columns by fasteners, such as coiled wire and the like.

The improved mattress core also includes means for increasing the edge firmness and the firmness of the transverse center portion of the mattress core. This means includes a pair of rectangular inner border rods spaced inwardly from an outer border rod in at least one of the top and bottom planes of the rectangular coil spring assembly. Each of the rectangular inner border rods has two side sections, a first end section oriented toward an end of the coil spring assembly, and a second end section oriented toward the transverse center region of the coil spring assembly.

Although the rectangular inner border rods may be located in different orientations relative to the rectangular coil spring assembly, usually the rectangular inner border rods are in alignment with the rectangular outer border rods. That is, the two side sections of each inner border rod are spaced inwardly and extend parallel to the side sections of an outer border rod, and the first end section of each inner border rod is spaced inwardly from and extends parallel to an end section of that outer border rod. Also, the second end section of each inner border rod lies in a parallel relationship to the second end section of the other of the pair of rectangular inner border rods.

Preferably, the side sections of the inner border rods are spaced inwardly about 1½ coil springs from the side sections of a particular outer border rod, and the first end section of each of the inner border rods is spaced inwardly about 1½ coil springs from the end section of that outer border rod. In addition, the second end section of each of the inner border rods is spaced about 3 coil springs apart from the second end section of the other one of the pair of inner border rods.

More preferably, the improved mattress core further includes a second pair of rectangular inner border rods in the other one of the top and bottom planes of the rectangular coil spring assembly. Usually, this second pair of inner border rods is oriented so that the respective pairs of rectangular inner border rods substantially underlie one another in the top and bottom planes of the assembly. In this more preferred construction, the edge firmness of the mattress core is increased by about 10%, and the firmness of the transverse center portion of the mattress core is increased by about 15%.

The rectangular inner border rods may be made of any of a number of different materials, such as nine gauge wire and the like. Furthermore, the inner border rods may be fastened to the coil spring assembly by a plurality of conventional fasteners, such as metal clips or hog rings.

The improved mattress core of this invention offers several benefits and advantages. One advantage is increased firmness along the perimeter or edge of the mattress, where a person typically sits. A further benefit is the enhanced firmness of the transverse center portion of the mattress core, where much of a person's weight is supported when lying on a mattress. These and other benefits and advantages will become apparent to one skilled in the art upon review of the following detailed description of the preferred embodiment and drawings.

DETAILED DESCRIPTION OF THE PREFERRED EMBODIMENT

Figure 1:
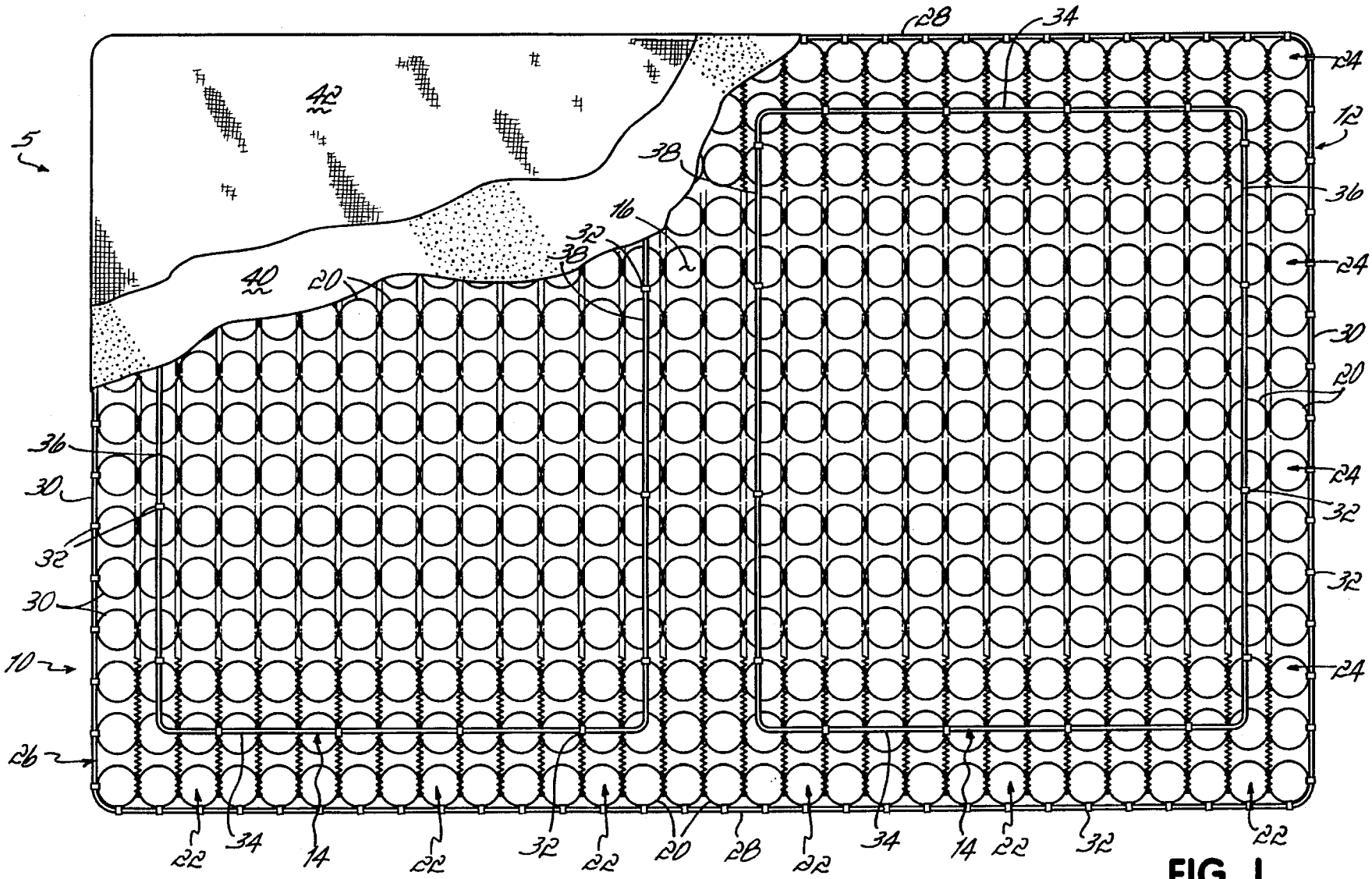
FIG. 1 is a schematic, partially broken away top plan view of an improved mattress of the invention.
Figure 2:
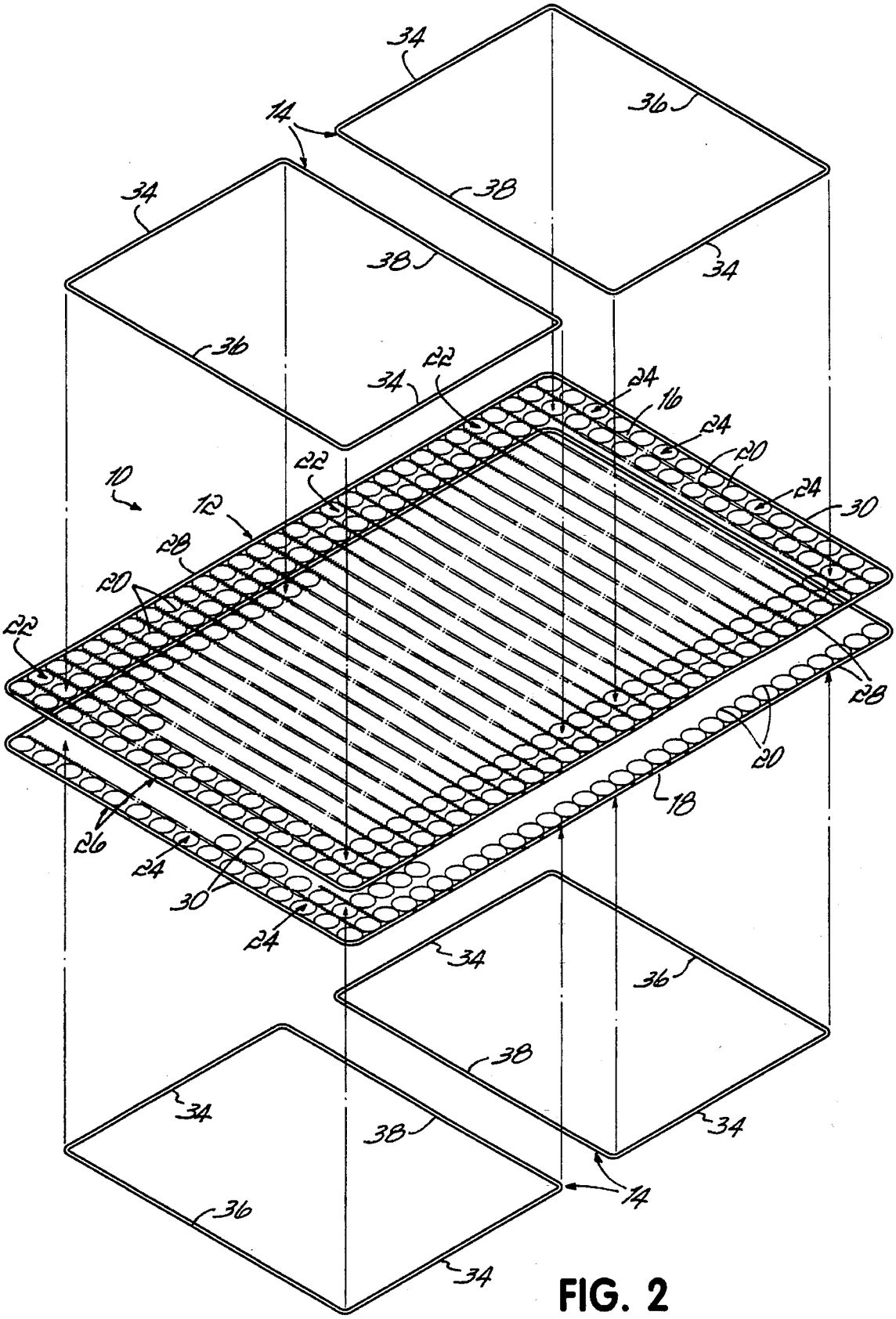
FIG. 2 is a schematic exploded perspective view of an improved mattress core according to the principles of the invention.

An improved mattress 5 and mattress core 10 according to the principles of the invention are shown in FIGS. 1 and 2. The mattress 5 has a mattress core 10, padding 40 over at least one side of the core 10, and an upholstered covering 42 encasing the mattress core 10 and padding 40. The improved mattress core 10 includes a rectangular coil spring assembly 12 and a means for increasing the edge firmness and the firmness of the transverse center portion of the mattress core 10. The means for increasing firmness includes a pair of rectangular inner border rods 14 in both the top and bottom planes 16, 18 of the coil spring assembly 12 (FIG. 2).

The rectangular coil spring assembly 12 includes a plurality of coil springs 20 arranged in a matrix configuration having a plurality of transverse coil spring rows 22 and a plurality of longitudinal coil spring columns 24. The assembly 12 further includes a pair of rectangular outer border rods 26 surrounding the coil springs 20 in the top and bottom planes 16, 18 of the assembly 12. The outer border rods 26 are secured to several of the endmost coils in the transverse coil spring rows 22 and longitudinal coil spring columns 24, completing the basic mattress core.

Each of the rectangular outer border rods 26 has two side sections 28 and two end sections 30. In addition, these side sections 28 and end sections 30 are connected to at least some of the endmost coil spring 20 in the transverse coil spring rows 22 and longitudinal coil spring columns 24 by conventional fasteners 32, preferably sheet metal clips.

In the preferred embodiment, a pair of inner rectangular border rods 14 is oriented in both the top plane 16 and bottom plane 18 of the rectangular coil spring assembly 12 as shown in FIG. 2. Each of the rectangular inner border rods 14 has two side sections 34, a first end section 36 and a second end section 38. The inner border rod side sections 34 are spaced inwardly and extend parallel to the outer border rod side section 28, and each of the first end sections 36 is spaced inwardly from and extends parallel to an end section 30 of an outer border rod 26 as shown in FIG. 1. The second end sections 38 of each pair of rectangular inner border rods 14 run parallel with one another in the transverse center section of the mattress core 10 (FIG. 1 ).

In this preferred embodiment, the side sections 34 of the inner border rods 14 are spaced inwardly about 1½ coil springs 20 from the side sections 28 of the outer border rods 26, and the first end section 36 of each of the inner border rods 14 is spaced inwardly about 1½ coil springs 20 from the end section 30 of each of the outer border rods 26. In addition, the second end section 38 of each of the inner border rods 14 is spaced about 3 coils springs 20 apart from the second end section 38 of the other one of the rectangular inner border rods in a given plane of the assembly 12 (FIG. 1 ). The inner border rods 14 are connected to at least some of the coil springs 20 in the top and bottom planes 16, 18 of the assembly 12 by conventional fasteners 32 such as metal clips or hog rings, thereby securing the inner border rods 14 in place.

In this embodiment, the pairs of rectangular inner border rods 14 substantially underlie one another in each of the top and bottom planes 16, 18 of the rectangular coil spring assembly 12. In addition, the rectangular inner border rods 14 typically are made of a nine gauge wire. This combination of positioning and material used for the rectangular inner border rods 14 results in an improved mattress core 10 wherein the edge firmness of the core 10 is increased by about 10% and the firmness of the transverse center portion is increased by about 15%. This firmness measure is obtained by supporting the mattress core upon a rigid supporting platform and using a movable eleven and one half inch (11½") square platen to push downwardly on the top surface of the mattress core until the platen has deflected the top surface of the core assembly by one and one half inches (1½"). Once the mattress core 10 is completed, the core 10 may be covered with the appropriate conventional padding 40 and fabric covering 42 to form a completed mattress 5.

As is readily understood by one of ordinary skill in the art, fewer than four rectangular border rods 14 may be used. For example, a pair of rectangular inner border rods 14 may be placed only in the top or bottom plane 16, 18 of the coil spring assembly 12. Additionally, the rectangular inner border rods 14 may be sized somewhat differently so that the positioning of the inner border rods 14 relative to the side sections 28 and end sections 30 of the outer border rods 26 is somewhat different from the preferred embodiment.

Various changes and modifications may be made to the invention described above without departing from the spirit and scope of the following claims.

What is claimed is:

1. An improved mattress comprising:

a mattress core, padding over at least one side of the core, and an upholstered covering encasing the mattress core and padding, said mattress core comprising:

(i) a rectangular coil spring assembly including a plurality of coil springs arranged in a matrix configuration having a plurality of transverse coil spring rows and a plurality of longitudinal coil spring columns, and a pair of rectangular outer border rods surrounding said coil springs in a top and bottom plane of said assembly, said outer border rods being secured to at least some the endmost coils in said transverse coil spring rows and said longitudinal coil spring columns; and (ii) a pair of rectangular inner border rods spaced inwardly from said outer border rods, each of said rectangular inner border rods having two side sections, a first end section and a second end section forming said rectangular inner border rod, said rectangular inner border rods being physically separated from and unattached to one another, said side and end sections controllably increasing the edge firmness and the firmness of the transverse center portion of the mattress core.

2. An improved mattress core comprising:

a rectangular coil spring assembly including a plurality of coil springs arranged in a matrix configuration having a plurality of transverse coil spring rows and a plurality of longitudinal coil spring columns, and a pair of rectangular outer border rods surrounding said coil springs in a top and bottom plane of said assembly, said outer border rods being secured to at least some of the endmost coils in said transverse coil spring rows and said longitudinal coil spring columns; and a pair of rectangular inner border rods spaced inwardly from said outer border rods, each of said rectangular inner border rods having two side sections, a first end section and a second end section forming said rectangular inner border rod, said rectangular inner border rods being physically separated from and unattached to one another, said side and end sections controllably increasing the edge firmness and the firmness of the transverse center portion of the mattress core.

3. The improved mattress core of claim 2 wherein said pair of rectangular inner border rods is located in at least one of said top and bottom planes of said assembly, each of said rectangular inner border rod side sections spaced inwardly from and extending parallel to side sections of said outer border rods, each of said rectangular inner border rod first end sections spaced inwardly from and extending parallel to an end section of said outer border rods, and said second end section of one of said rectangular inner border rods extending parallel to and spaced from said second end section of the other of said pair of rectangular inner border rods.

4. The improved mattress core of claim 3 wherein said rectangular inner border rods are fastened to said assembly by a plurality of fasteners.

5. The improved mattress core of claim 3 wherein said side sections of said rectangular inner border rods are spaced inwardly about 1½ coil springs from said side sections of said outer border rods, said first end section of each of said rectangular inner border rods is spaced inwardly about 1½ coil springs from one of said end sections of said outer border rods, and said second end section of one of said rectangular inner border rods is spaced about 3 coil springs apart from said second end section of the other of said rectangular inner border rods.

6. The improved mattress core of claim 5 further including a second pair of rectangular inner border rods.

7. The improved mattress core of claim 6 wherein said pairs of rectangular inner border rods substantially underlie one another in said top and bottom planes of said assembly.

8. The improved mattress core of claim 7 wherein said edge firmness of said core is increased by about 10% and said firmness of said transverse center portion is increased by about 15%.

9. The improved mattress core of claim 2 wherein said rectangular inner border rods are made of nine gauge wire.

10. The improved mattress core of claim 2 wherein said pair of rectangular inner border rods is located in at least one of said top and bottom planes of said assembly.

11. The improved mattress core of claim 10 wherein one of said pair of rectangular inner border rods is located in said top plane and the other of said pair is located in said bottom plane.

12. The improved mattress core of claim 10 wherein said pair of rectangular inner border rods is located in the same plane selected from the group consisting of said top plane and said bottom plane.

13. The improved mattress core of claim 2 wherein said pair of rectangular inner border rods are positioned in noncontacting relationship with one another.

14. An improved mattress core comprising:

a rectangular coil spring assembly including a plurality of coil springs arranged in a matrix configuration having a plurality of transverse coil spring rows and a plurality of longitudinal coil spring columns, and a pair of rectangular outer border rods surrounding said coil springs in a top and bottom plane of said assembly, said outer border rods being secured to at least some of the endmost coils in said transverse coil spring rows and said longitudinal coil spring columns; and a pair of rectangular inner border rods spaced inwardly from said outer border rods, each of said rectangular inner border rods having two side sections, a first end section and a second end section forming said rectangular inner border rod, said rectangular inner border rods being physically separated from and unattached to one another, said side and end sections controllably increasing the edge firmness of the mattress core by approximately 10% and the firmness of the transverse center portion of the mattress core by approximately 15%.

15. The method of increasing the edge and center portion firmness of a mattress core having a rectangular coil spring assembly including a plurality of coil springs arranged in a plurality of transverse coil spring rows and a plurality of longitudinal coil spring columns, and a pair of rectangular outer border rods surrounding said coil springs in a top and bottom plane of said assembly, said outer border rods being secured to at least some of the endmost coils in said transverse coil spring rows and said longitudinal coil spring columns, which method comprises:

locating a pair of rectangular inner border rods in at least one of the top and bottom planes of said spring assembly and spaced inwardly from said outer border rods, each of said rectangular inner border rods having two side sections, a first end section and a second end section forming said rectangular inner border rod, said rectangular inner border rods being physically separated from and unattached to one another; and securing said rectangular inner border rods to said coil springs so that said side and end sections controllably increase the edge firmness and the firmness of the transverse center portion of the mattress core.

16. The method of increasing the edge and center portion firmness of a mattress core having a rectangular coil spring assembly including a plurality of coil springs arranged in a plurality of transverse coil spring rows and a plurality of longitudinal coil spring columns, and a pair of rectangular outer border rods surrounding said coil springs in a top and bottom plane of said assembly, said outer border rods being secured to at least some of the endmost coils in said transverse coil spring rows and said longitudinal coil spring columns, which method comprises:

locating a pair of rectangular inner border rods in at least one of the top and bottom planes of said spring assembly and spaced inwardly from said outer border rods, each of said rectangular inner border rods having two side sections, a first end section and a second end section forming said rectangular inner border rod, said rectangular inner border rods being physically separated from and unattached to one another; and securing said rectangular inner border rods to said coil springs so that said side and end sections controllably increase the edge firmness of said mattress core by approximately 10% and the firmness of the transverse center portion of the mattress core by approximately 15%.

* * * * *